US007503556B2

(12) United States Patent
Sugimoto et al.

(10) Patent No.: US 7,503,556 B2
(45) Date of Patent: Mar. 17, 2009

(54) SHEET FINISHER, SHEET FINISHING METHOD AND IMAGE FORMING APPARATUS

(75) Inventors: Eiji Sugimoto, Hachioji (JP); Teruhiko Toyoizumi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 118 days.

(21) Appl. No.: 11/483,470

(22) Filed: Jul. 10, 2006

(65) Prior Publication Data

US 2007/0063409 A1 Mar. 22, 2007

(30) Foreign Application Priority Data

Sep. 20, 2005 (JP) ..... 2005-271693

(51) Int. Cl.
*B65H 37/04* (2006.01)

(52) U.S. Cl. ..... 270/58.09; 270/32; 270/37; 270/58.04; 270/58.02

(58) Field of Classification Search ..... 270/32, 270/37, 58.02, 58.04, 58.09; 493/416, 434, 493/435

See application file for complete search history.

(56) References Cited

U.S. PATENT DOCUMENTS 6,475,129 B1 * 11/2002 Lehmann ..... 493/421
7,040,612 B2 * 5/2006 Garner et al. ..... 270/8
2004/0183246 A1 * 9/2004 Jung et al. ..... 270/37

FOREIGN PATENT DOCUMENTS

JP 10-279177 A 10/1998

* cited by examiner

*Primary Examiner*—Gene Crawford
*Assistant Examiner*—Leslie A Nicholson, III
(74) *Attorney, Agent, or Firm*—Frishauf, Holtz, Goodman & Chick, P.C.

(57) ABSTRACT

Disclosed is a sheet finisher including: a push-in member to push a sheet bundle; a pair of rollers to fold the sheet bundle pushed-in by the push-in member; a movement member to move at least one roller of the pair of rollers; an acquiring member to acquire information of a thickness of the sheet bundle; and a control member to control the movement member so as to adjust a clearance between the pair of rollers, based on the information of the thickness of the sheet bundle acquired by the acquiring member.

10 Claims, 10 Drawing Sheets

(TO SHEET FINISHING MAIN ROUTINE)
(START FOLDING PROCESSING)

FIG.8

| PAPER TYPE | SHEET THICKNESS |
|---|---|
| GLOSSY PAPER | t2 |
| PLAIN PAPER | t3 |
| TRACING PAPER | t4 |
| OHP | t5 |
| ▪ | ▪ |
| ▪ | ▪ |
| ▪ | ▪ |

FIG.11

| CONSUMPTION CURRENT | SHEET BUNDLE THICKNESS |
|---|---|
| i1 | t11 |
| i2 | t12 |
| i3 | t13 |
| i4 | t14 |
| ▪ | ▪ |
| ▪ | ▪ |
| ▪ | ▪ |

SHEET FINISHER, SHEET FINISHING METHOD AND IMAGE FORMING APPARATUS

BACKGROUND

1. Field of the Invention

The present invention relates to a sheet finisher, a sheet finishing method and an image forming apparatus.

2. Description of Related Art

In recent years, a sheet finisher to finish a plurality of sheets into booklet forms of various thicknesses has been required.

In such a sheet finisher, there has been proposed a sheet folding mechanism in a booklet producing apparatus (see, for example, JP Hei 10-279177A), which can accord a folding position by a folding roller with the positions of stitching pins of the booklet (sheet bundle) with high accuracy and can accurately fold the sheets along the positions of the stitching pins of the sheet bundle by moving one folding roller to follow the other folding roller into an opposite direction.

However, the sheet folding mechanism of the booklet producing apparatus (sheet finisher) described in JP Hei 10-279177A has a problem in which it is difficult to apply a proper pressing force for folding according to the thickness of a sheet bundle, although the sheet folding mechanism can accord the positions of the stitching pins of the sheet bundle with the folding position thereof by the folding roller. That is, when the folding pressure of the sheet folding mechanism is adjusted to a thin sheet bundle, the pressing force becomes excessive to a thick sheet bundle, and the fold line of the thick sheet bundle becomes easy to deviate. When the folding pressure of the sheet folding mechanism is adjusted to a thick sheet bundle, the pressing force becomes insufficient for a thin sheet bundle, and the fold line of the thin sheet bundle becomes loose. Thus, the sheet folding mechanism can deal with only a specific thickness.

SUMMARY

It is an object of the present invention to provide a sheet finisher, a sheet finishing method and an image forming apparatus, each capable of stably producing a high-quality sheet bundle (booklet) which is folded at the center of the sheets without any deviations of the sheets independent of the thickness of the sheet bundle.

The above object of the present invention is attained by the following.

According to a first aspect of the invention, a sheet finisher comprises: push-in member to push a sheet bundle; a pair of rollers to fold the sheet bundle pushed-in by the push-in member; a movement member to move at least one roller of the pair of rollers; an acquiring member to acquire information of a thickness of the sheet bundle; and a control member to control the movement member so as to adjust a clearance between the pair of rollers, based on the information of the thickness of the sheet bundle acquired by the acquiring member.

According to a second aspect of the invention, a sheet finishing method comprises the steps of: measuring a thickness of a sheet bundle; adjusting a clearance between a pair of rollers based on the measured thickness of the sheet bundle; pushing-in the sheet bundle between the pair of rollers; and folding the pushed-in sheet bundle.

According to a third aspect of the invention, an image forming apparatus comprises: an image forming member to form an image on a sheet; a conveyance member to convey the sheet from the image forming member; a push-in member to push a sheet bundle of the sheet conveyed from the conveyance member a pair of rollers to fold the sheet bundle pushed-in by the push-in member; a movement member to move at least one roller of the pair of rollers; an acquiring member to acquire information of a thickness of the sheet bundle; and a control member to control the movement member so as to adjust a clearance between the pair of rollers, based on the information of the thickness of the sheet bundle acquired by the acquiring member.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein;

FIG. 8 is an example of a correspondence table of paper types and thicknesses;

FIG. 11 is an example of a correspondence table of consumption currents and sheet bundle thicknesses.

DETAILED DESCRIPTION OF THE PREFERRED EMBODIMENTS

In the following, the embodiments of the present invention are described, but the description does not limit the scope of the claims and the interpretation of terms.

Figure 1:
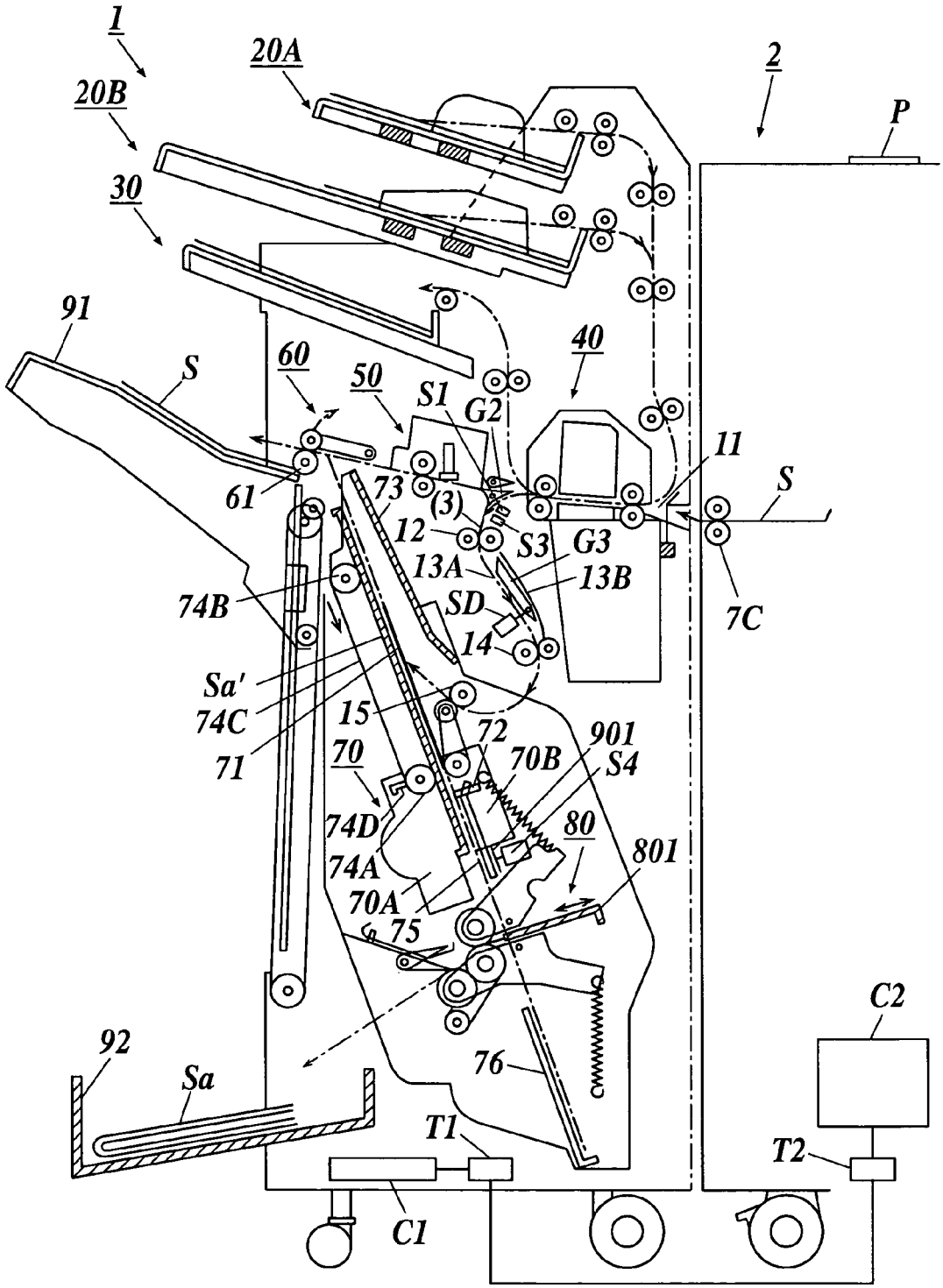
FIG. 1 is a cross-sectional configuration view showing an example of a sheet finisher.

FIG. 1 is a cross-sectional configuration view showing an example of a sheet finisher.

As the sheet finishing functions, there are a stitching function (stitching is also described as stapling in the following), a folding function, a punching function, a binding function and the like. Here, the folding function and the stapling function are taken for an example, and the configuration, the operation, the control, the cooperation of an image formation apparatus, and the like of the sheet finisher are described below.

In the sheet finisher 1, as shown in FIG. 1, a first paper feeding apparatus 20A, a second paper feeding apparatus 20B, and a fixed paper ejection tray 30 are arranged at the upper step; punching member 40, shifting member 50 and paper ejection member 60 are arranged in series on the same plane which is located at the middle step to be almost horizontal; and stapling member 70 and folding member 80 are arranged in series on the same plane forming an inclined surface at the lower step.

Moreover, on the shown left side wall of the sheet finisher 1, an ascending and descending paper ejection tray 91 loading sheets having been subjected to shifting processing and sheet bundles having been subjected to stapling processing, and a fixed paper ejection tray 92 loading processed sheet bundles having been subjected to folding processing to be folded into three or two are arranged.

The position and the height of the sheet finisher 1 are adjusted and installed so that a receiving portion 11 of a sheet S carried out from an image formation apparatus 2 may accord with a paper ejection unit 7C of the image formation apparatus 2.

The sheet S subjected to image formation processing is carried from the image formation apparatus 2 into the receiving portion 11. The image forming apparatus 2 comprises an image forming member 21 (see FIG. 5) to form an image on a sheet and a conveyance member 22 (see FIG. 5) to convey the sheet from the image forming member to a pair of rollers (folding rollers 802 described below), and the sheet is conveyed from the conveyance member to the receiving portion 11.

The sheet S, which has been subjected to the image formation processing in the image formation apparatus 2 and has been fed into the receiving portion 11 of the sheet finisher 1, passes through the punching member 40 and a switching gate G2, and is detected by a sheet sensor (passage sensor) S1 detecting a passing sheet and a paper type sensor (type sensor) S3 detecting a paper type of the sheet. Then, the sheet S is supported by conveyance rollers 12 in a state of being put between them, and is fed into a third conveyance path (3) at a downstream position of the sheet sensor S1 and the paper type sensor S3 to be conveyed downward.

When a sheet S having a size larger than A-4 size or B-5 size is conveyed in the third conveyance path (3), a solenoid SD is driven so that the sheet S may pass through a paper passing path 13A on the left side of a shown switching gate G3, and then the sheet S is supported by resist rollers 14 in a state of being put between them to be conveyed downward.

The sheet S is supported by conveyance rollers 15, located at a further downstream position, in a state of being picked between them, and then is sent out from the conveyance rollers 15. Thereafter, the sheet S is ejected into the upper space of an intermediate stacker 71 arranged to be inclined, and touches the intermediate stacker 71 or the top surface of the sheets S loaded on the intermediate stacker 71 to be conveyed obliquely upward.

After the rear end of the sheet S in the conveying direction has been ejected from a supported position by the conveyance rollers 15 in the state of being put between them, the conveying direction of the sheet S is changed to descent owing to its own weight, and is conveyed on the inclined surface of the intermediate stacker 71. Then, the rear end of the sheet S contact with a surface which the sheet S has struck a movable stopper member for a staple (hereinafter referred to as a staple stopper) 72 in the neighborhood of the stapling member 70, and the sheet S stops there.

When a sheet S' (not shown) of a small size such as A-4 size, B-5 size or the like is processed in the third conveyance path (3), the solenoid SD connected to the switching gate G3 is driven when a first sheet is conveyed, and the paper passing path 13A on the left side of the shown switching gate G3 is closed and a paper passing path 13B parallel to the paper passing path 13A is opened.

The front end of the first sheet S' of small size, which has been sent out from the conveyance rollers 12, passes through the paper passing path 13B, and contacts with the circumferential surface of the resist rollers 14 in a halt state of rotation to stop there.

Next, the electrification to the solenoid SD is turned off, and the front end of the switching gate G3 swings clockwise. Then, the front end of the switching gate G3 closes the paper passing path 13B, and opens the paper passing path 13A. The front end of a second sheet S' sent out from the conveyance rollers 12 passes through the paper passing path 13A, and contacts with the circumferential surface of the resist rollers 14 in a halt state of rotation to stop there. Consequently, the first sheet S' and the second sheet S' do not collide with each other, and are conveyed sequentially. Then, each of the front ends of the first sheet S' and the second sheet S' overlap with each other, and the first and the second sheets S' stop there to be in a standby state.

In predetermined timing, the resist rollers 14 is driven to rotate, and support the two sheets S' in a state of picking them between to convey them simultaneously. Then, the resist rollers 14 eject the two sheets S' onto the intermediate stacker 71. A third and following sheets S are ejected one by one by the resist rollers 14.

A reference numeral 73 denotes a pair of width adjustment members movably provided on both the sides of the intermediate stacker 71. The width adjustment members 73 are movable in a direction perpendicular to the sheet conveyance direction (the direction of the front side and the back side of paper surfaces). At the time of sheet receiving when the sheet S or the sheet S' (hereinafter the sheet S and the sheet S' are representatively indicated by a sheet S) is conveyed on the intermediate stacker 71, the width adjustment members 73 are opened to be wider than the sheet width. When the sheet S is conveyed on the intermediate stacker 71 and contacts with the staple stopper 72 to be stopped there, the width adjustment members 73 lightly hit the side edges of the sheet S in the width direction to make the width of the sheet S uniform (width adjustment). When the predetermined number of the sheets S have been loaded and adjusted on the intermediate stacker 71 at the stop position, the stapling processing, which will be described later, is performed by the stapling member 70, and the predetermined number of the sheets S are coupled with staples.

The stapling member 70 is configured by a dual-partitioning structure of a pin driving mechanism 70A and pin receiving mechanism 70B, and has a paper passing path 75, through which the sheet S can pass, at the middle of the pin driving mechanism 70A and the pin receiving mechanism 70B.

Figure 2:
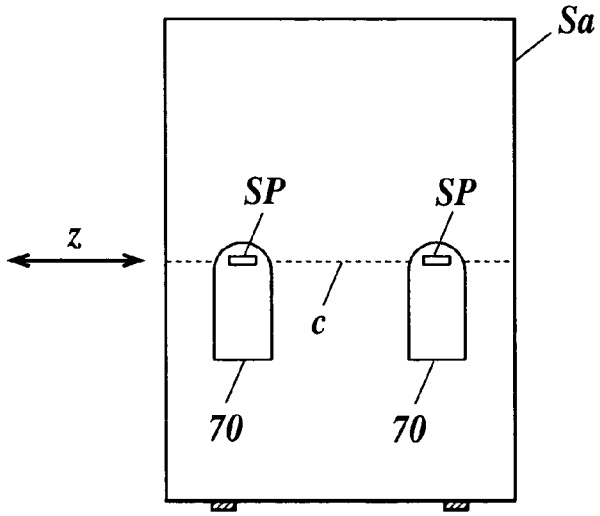
FIG. 2 is a conceptual diagram showing the positions of staple pins SP and stapling member 70 in the case of performing center staple processing.

FIG. 2 is a conceptual diagram of the positions of the staple pins SP and the stapling member 70 in the case of performing the center staple processing.

A pair of the stapling members 70 are arranged in the direction perpendicular to the sheet conveyance direction, and are moved in the direction perpendicular to the sheet conveyance direction by a drive unit (not shown). Thereby, the stapling members 70 make it possible to drive the staple pins SP at two positions of the center in the width direction of the sheets of a sheet bundle Sa composed of the whole page of the sheets S constituting a booklet (center stapling). The stapling processing may be performed at other positions by moving the stapling members 70.

A part of the sheet loading surface of the intermediate stacker 71 is lacked, and a plurality of ejection belts 74C wound around a drive pulley 74A and a driven pulley 74B is driven in the direction indicated by an arrow. Ejection claws 74D are formed integrally with the ejection belts 74C at parts of the ejection belts 74C, and the front end parts of the ejection claws 74D move to draw elliptical loci when the ejection belts 74C are driven.

When only the stapling processing is performed, the sheets S having received the stapling processing slide on the mounting surface of the intermediate stacker 71 in the state of being loaded on the ejection belts 74C with the rear end parts of the sheets S supported by the ejection claws 74D of the ejection belts 74C, and are pushed up obliquely upward to advance to the position of ejection rollers 61 of the paper ejection means where the ejection rollers 61 support the sheets S in a state of putting them between.

The sheets supported in a state of being picked by the rotating ejection rollers 61 are ejected and loaded on the ascending and descending paper ejection tray 91.

A reference sign S4 denotes a sheet bundle thickness sensor (sheet bundle thickness measuring unit) measuring the thickness of a sheet bundle stacked on the intermediate stacker 71. During the stacking of the sheets, the sensor head 901 of the sheet bundle thickness sensor S4 retreats to retract in order not to block the movement of the sheets. When the stacking of the sheets is completed, the sheet bundle thickness sensor S4 moves the sensor head 901 forward to contact with the sheet bundle, and measures as a sheet bundle thickness a difference between a measured value of the distance between the sensor head 901 and the surface of the intermediate stacker 71 when no sheets are loaded on the stacker 71, which measured value has been measured in advance, and a measured value of the distance when the sensor head 901 abuts the sheet bundle.

Control member C1 controls the whole sheet finisher 1, and performs communication with a control member C2 of the image formation apparatus 2 through a communication member T2 of the image processing apparatus 2 and a communication member T1 of the sheet finisher 1. The control member C1 is configured to be able to receive sheet finishing information (stapling processing, folding processing, punching processing, binding processing and the like), which has been selected with an operation panel P or the like of the image formation apparatus 2, the information of the number of the sheets S to be a booklet or a sheet bundle, the information of starting or ending the ejection of the sheets S to be the booklet or a sheet bundle, paper type information and the like. The control member C1 also functions as a counting unit (not shown) to count the number or sheet detected by the after-mentioned sheet sensor S1 and a calculation unit (not shown) to calculate a product of the detected sheet number and the one-sheet thickness so as to detect a sheet bundle thickness. The acquiring member of the invention includes the sheet sensor S1, counting unit and calculation unit.

Then, a stapled sheet bundle Sa' having been stapled by the center stapling is folded at the center c of the stapled sheet bundle Sa' by the folding member 80, and is ejected to the fixed paper ejection tray 92.

In the following, the folding member 80 is described in detail.

Figure 3:
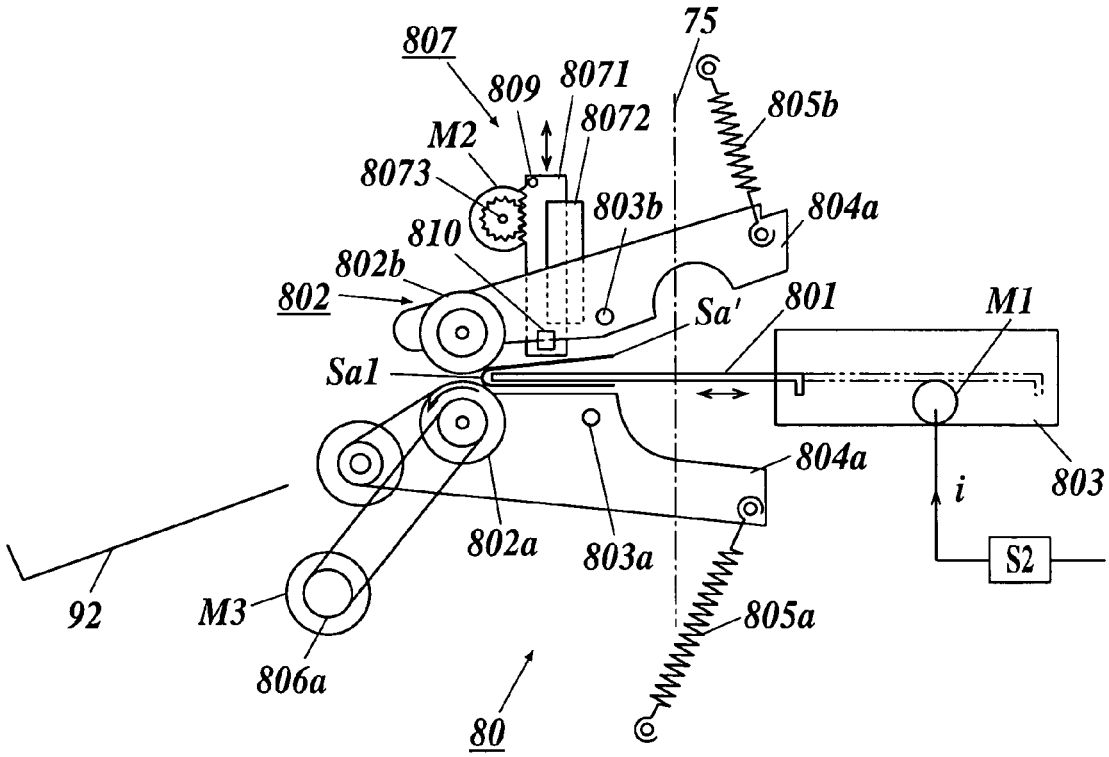
FIG. 3 is an explanatory diagram of a folding member.

FIG. 3 is an explanatory diagram of the folding member 80.

The folding member 80 includes: a pair of folding rollers 802 pressing the stapled sheet bundle Sa' to fold the stapled sheet bundle Sa'; a pushing-in unit 801 (push-in member) pushing the back part Sa1 of the stapled sheet bundle Sa' into the clearance between the pair of folding rollers 802; a pushing-in unit driving unit 803 (push-in member) driving the pushing-in unit 801 to move from a retraction position (alternate long and short dash line) at which the front end of the pushing-in unit 801 does not intersect the paper passing path 75 to a position (solid line) at which the back part Sa1 of the stapled sheet bundle Sa' pushed by the front end of the pushing-in unit 801 is pushed into the clearance between the folding rollers 802; a driving folding roller 802*a*, which is driven one between the pair of the folding rollers 802; a swing unit 804*a*, which supports the axis of the driving folding roller 802*a* and enables the swing of the driving folding roller 802*a* around an axis 803*a*; an elastic body 805*a* biasing the driving folding roller 802*a* to a driven folding roller 802*b*; a swing unit 804*b*, which supports the axis of the driven folding roller 802*b* and enables the swing of the driven folding roller 802*b* around an axis 803*b*; an elastic body 805*b* biasing the driven folding roller 802*b* to the driving folding roller 802*a*; and movement unit 807 pulling up the swing unit 804*b* upward as shown in FIG. 3.

The movement unit 807 includes a movement part 8071 moving the driven folding roller 802*b* through the swing unit 804*b* in the direction in which the clearance of the driving folding roller 802*a* and the driven folding roller 802*b* opens and closes (vertical direction in FIG. 3), a guide part 8072 guiding the movement of the movement part 8071, and a drive unit 8073 including a motor M2 moving the movement part 8071 (for example, the drive unit 8073 and the movement part 8071 constitute rack and pinion).

In addition, a hook 810 is formed at the shown lower end of the movement part 8071. In rising the movement part 8071 (at the time of movement), the swing unit 804*b* is hooked and raised by the hook 810, and the driven folding roller 802*b* can be moved in the direction to be separated from the driving folding roller 802*a*.

The movable length of the swing unit 804*b* by the movement unit 807 is equal to or more than the maximum thickness of the back part Sa1 of the sheet bundle Sa after the pressing, preferably equal to the maximum thickness of back part Sa1 of the sheet bundle Sa before the pressing.

The pushing-in unit driving unit 803 includes a pushing-in motor M1, which longitudinally moves the pushing-in unit 801, and a sensor S2 (measuring member) measuring a consumption current (drive current) i of the pushing-in motor M1.

The operation of folding is described. The movement unit 807 moves (raises) the driven folding roller 802*b* to widen the clearance between the driving folding roller 802*a* and the driven folding roller 802*b* to be a dimension corresponding to the thickness of the stapled sheet bundle Sa'.

Then, the stapled sheet bundle Sa' located in the paper passing path 75 is folded into a dogleg while moving forward by the pushing-in unit 801, which moves forward (into the left-hand direction in FIG. 3) by the drive of the pushing-in motor M1, and is pushed in until the back part Sa1 has entered into the clearance between the driving folding roller 802*a* and the driven folding roller 802*b*, which clearance is spaced to the dimension according to the stapled sheet bundle Sa'.

When the pushing-in has been completed, the pushing-in unit 801 returns to the origin position indicated by the alternate long and short dash line by reverse rotation of the pushing-in motor M1.

The back part Sa1 of the pushed-in stapled sheet bundle Sa' receives the pressing forces from the driving folding roller 802*a* and the driven folding roller 802*b* by the biasing forces of the elastic bodies 805*a* and 805*b*, and the pushed-in stapled sheet bundle Sa' is surely folded to be in a booklet state. Then, the stapled sheet bundle Sa' in the booklet state is sent by the drive of a roller rotation motor M3 until it has passed through the clearance between the driving folding roller 802*a* and the driven folding roller 802*b*. Furthermore, the roller rotation motor M3 rotates, and the stapled sheet bundle Sa' is pushed out toward the fixed paper ejection tray 92.

Figure 4:
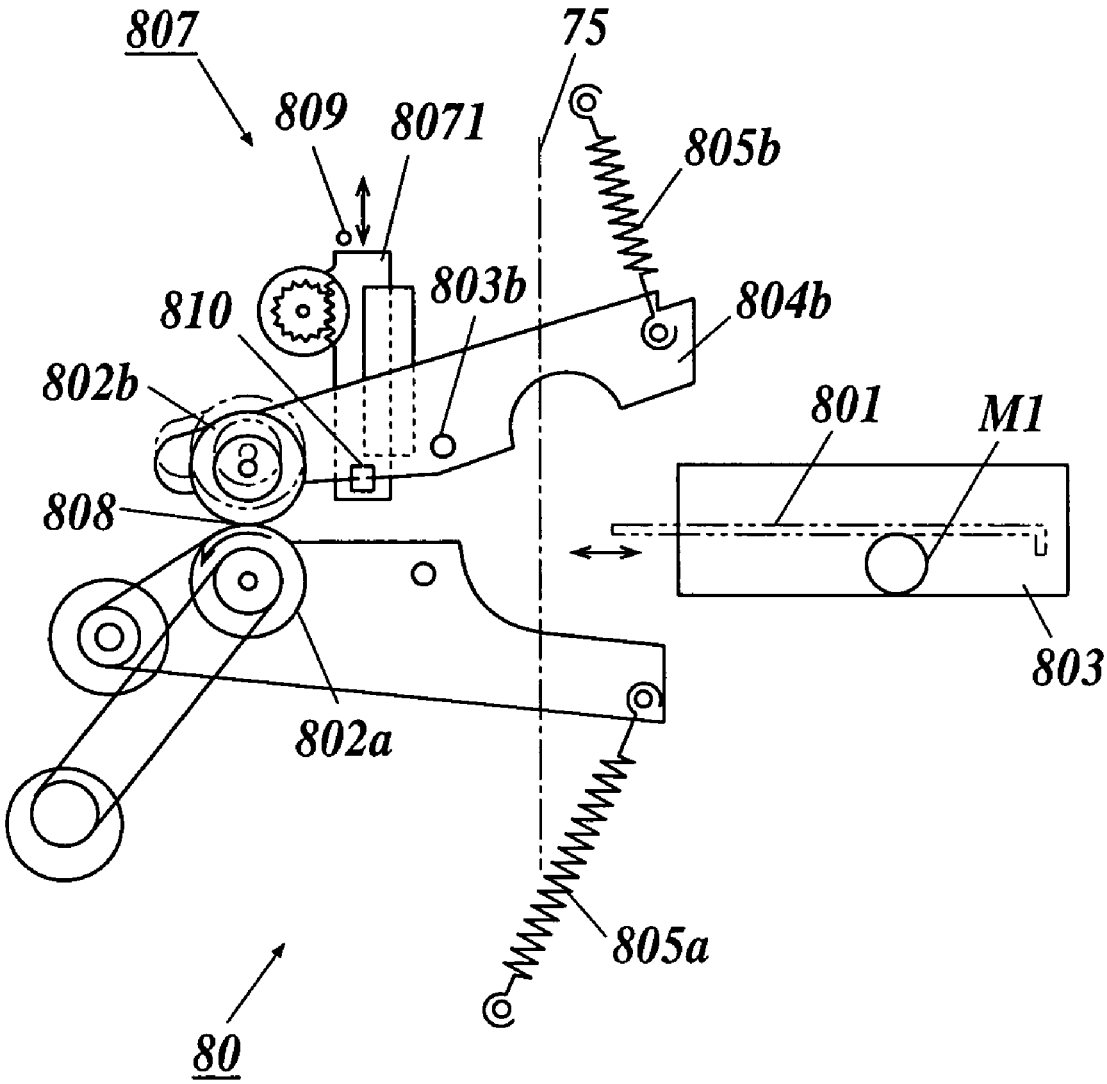
FIG. 4 is the conceptual diagram of the folding member when it is not performing the folding of a material.

FIG. 4 is a conceptual diagram of the folding member at the time of not performing the folding of any material.

The pushing-in unit 801 is retracted at the retraction position (alternate long and short dash line) where the front end of the pushing-in unit 801 does not intersect the paper passing path 75.

Moreover, as for the driven folding roller 802*b*, the clearance between the driving folding roller 802*a* and the driven folding roller 802*b* is spaced to the dimension corresponding to the stapled sheet bundle Sa'.

That is, because the thickness of the stapled sheet bundle Sa' is very thin in the case where a sheet bundle Sa composed of from one to several sheets S is subjected to folding processing, for example, the movement unit 807 operates little, and the driving folding roller 802*a* and the driven folding roller 802*b* are left in the state of contacting with each other. When the stapled sheet bundle Sa' is pushed in, the clearance between the driving folding roller 802*a* and the driven folding roller 802*b* is very slightly spaced, and pressing forces can be applied onto the stapled sheet bundle Sa' by the biasing forces of the elastic bodies 805*a* and 805*b* made of springs or the like.

Moreover, because the thickness of the stapled sheet bundle Sa' becomes thick in the case where a sheet bundle Sa composed of many sheets S is subjected to folding processing, the movement unit 807 operates, and the clearance between the driving folding roller 802*a* and the driven folding roller 802*b* is spaced to a distance corresponding to the thickness of the stapled sheet bundle Sa'.

When the stapled sheet bundle Sa' is pushed in, the clearance between the driving folding roller 802*a* and the driven folding roller 802*b* is opened a little, and pressing forces are applied onto the stapled sheet bundle Sa' by the biasing forces of the elastic bodies 805*a* and 805*b* made of springs or the like.

A position of the movement unit 807 shown by a solid line at which the sheet bundle Sa is not pushed in and the driven folding roller 802*b* and the driving folding roller 802*a* contact with each other is supposed to the origin position of the movement unit 807, and an origin sensor 809 detecting the origin position of the movement unit 807 detects that the movement part 8071 has descended to be located at the origin position.

In addition, the clearance between the driving folding roller 802*a* and the driven folding roller 802*b* may be set to contact with each other at the time of starting folding processing (at the time of not performing the folding of any material) even in the case of performing the folding processing of a sheet bundle Sa composed of many sheets S.

In this case, as mentioned above, the sheet bundle Sa is pushed in by the pushing-in unit 801 while the driven folding roller 802*b* is raised according to the thickness of the sheet bundle Sa to adjust the clearance between the driven folding roller 802*b* and the driving folding roller 802*a* to the clearance corresponding to the thickness of the sheet bundle Sa. In the following embodiment, it is described that the clearance between the driving folding roller 802*a* and driven folding roller 802*b* is widen to adjust it. The clearance also may be adjusted by narrowing it.

In this manner, by actively widening the clearance between the driving folding roller 802*a* and the driven folding roller 802*b* according to the thickness of a sheet bundle Sa, the clearance between the driving folding roller 802*a* and the driven folding roller 802*b* is opened when the pushing-in of the sheet bundle Sa between the driving folding roller 802*a* and the driven folding roller 802*b* is started. Consequently, the force to shift the sheets of the sheet bundle Sa which force is applied to the sheet bundle Sa can be reduced, and the shifts or the like of the sheet bundle Sa can be reduced.

Although the configuration in which a rotation drive is performed to on one roller (for example, the driving folding roller 802*a*) between the pair of the folding rollers 802 and the other roller (for example, the driven folding roller 802*b*) is moved according to the thickness of a sheet bundle Sa has been described above, a configuration may be adopted in which both of the rotation drive unit and the movement unit, which have been mentioned above, are severally provided on both of the rollers and both of the rollers are severally subjected to the rotation drive and the movement by equal distances according to the thickness of the sheet bundle.

By adopting such a configuration, both surfaces of a sheet bundle are driven to make it possible to convey the sheet bundle stably. Moreover, it becomes possible to push in the sheet bundle at the center of the rear part thereof, and it becomes possible to perform the stable folding processing of the sheets without any shifts of the sheets.

Figure 5:
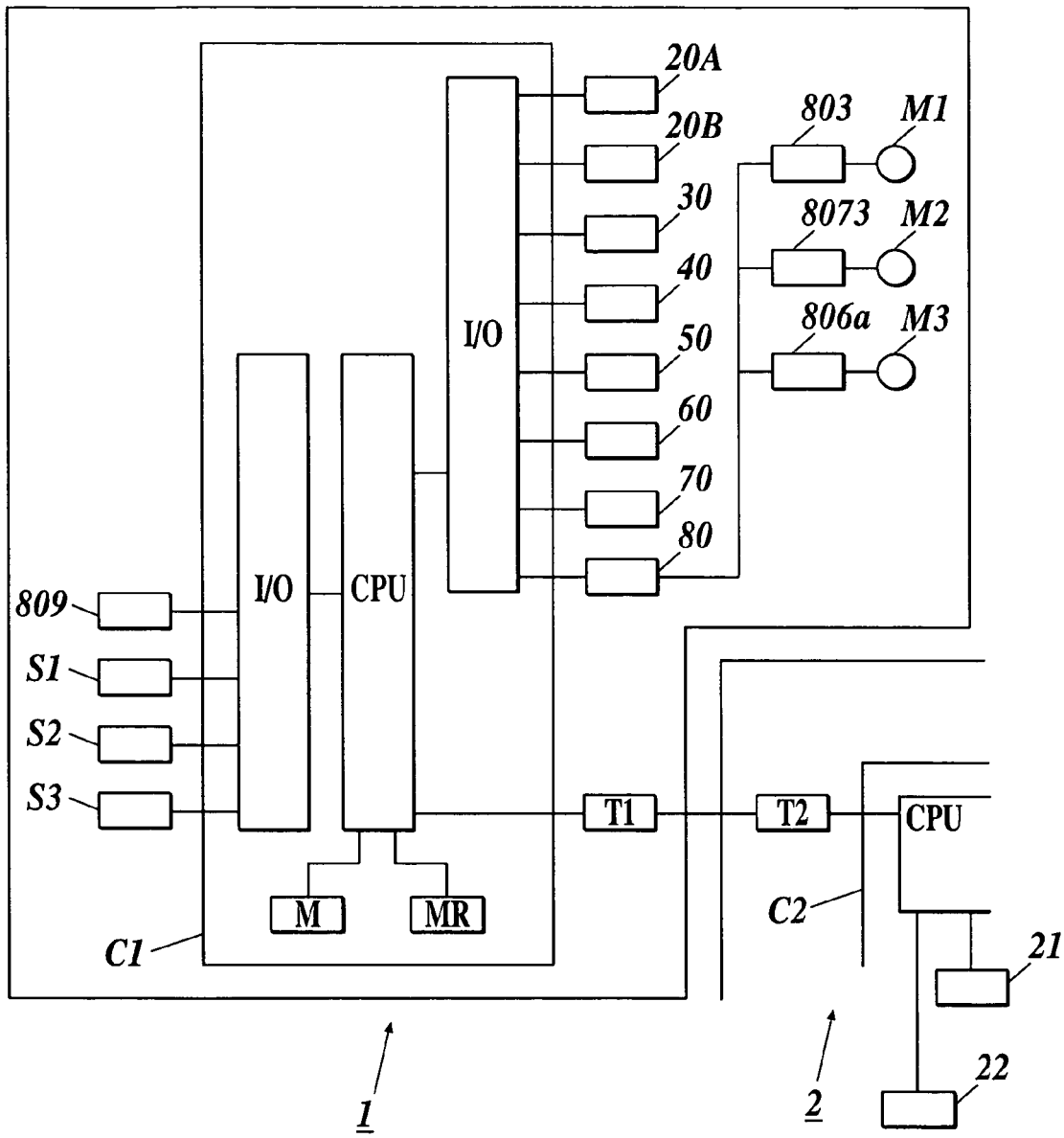
FIG. 5 is a block diagram of the sheet finisher relative to the folding of the material.

FIG. 5 is a block diagram relative to the folding of a material of the sheet finisher.

The origin sensor 809, the sheet sensor S1, the current sensor S2, the paper type sensor S3, the first paper feeding apparatus 20A, the second paper feeding apparatus 20B, the fixed paper ejection tray 30, the punching member 40, the shifting member 50, the paper ejection member 60, the stapling member 70, the folding member 80, and the communication member T1 performing the communication with the control member C2 of the image formation apparatus 2 through the communication member T2 are connected to the control member C1 of the sheet finisher 1.

Then, the folding member 80 includes the pushing-in unit driving unit 803 driving the pushing-in unit 801, the drive unit 8073 driving the movement part 8071, and the drive folding roller rotation unit 806*a* performing the rotation drive of the driving folding roller 802*a*. The pushing-in motor M1 of the pushing-in unit driving unit 803, the movement motor M2 of the drive unit 8073, the roller rotation motor M3 of the drive folding roller rotation unit 806*a*, and the like are connected to the control member C1 through an I/O.

The control member C1 includes a CPU, a read only memory (ROM) M in which the control program of the whole prost-processing apparatus 1 and various tables are previously stored, a random access memory (RAM) MR which performs the reading and the writing of various data and is backed up by a battery, and interface units I/O with the various sensors and the various output members, which have been described above. The control member C1 also functions as a paper type acquiring unit (not shown) to acquire paper type information of the sheet from the detection result of the paper type sensor S3 and a detection unit (not shown) to detect a one-sheet thickness from a correspondence table of paper types and sheet thicknesses, and the above-described calculation unit calculates a sheet bundle thickness as a product of the sheet number detected by the counting unit and one-sheet thickness detected by the detection unit. The acquiring member of the invention includes the paper type acquiring unit and detection unit.

Figure 6:
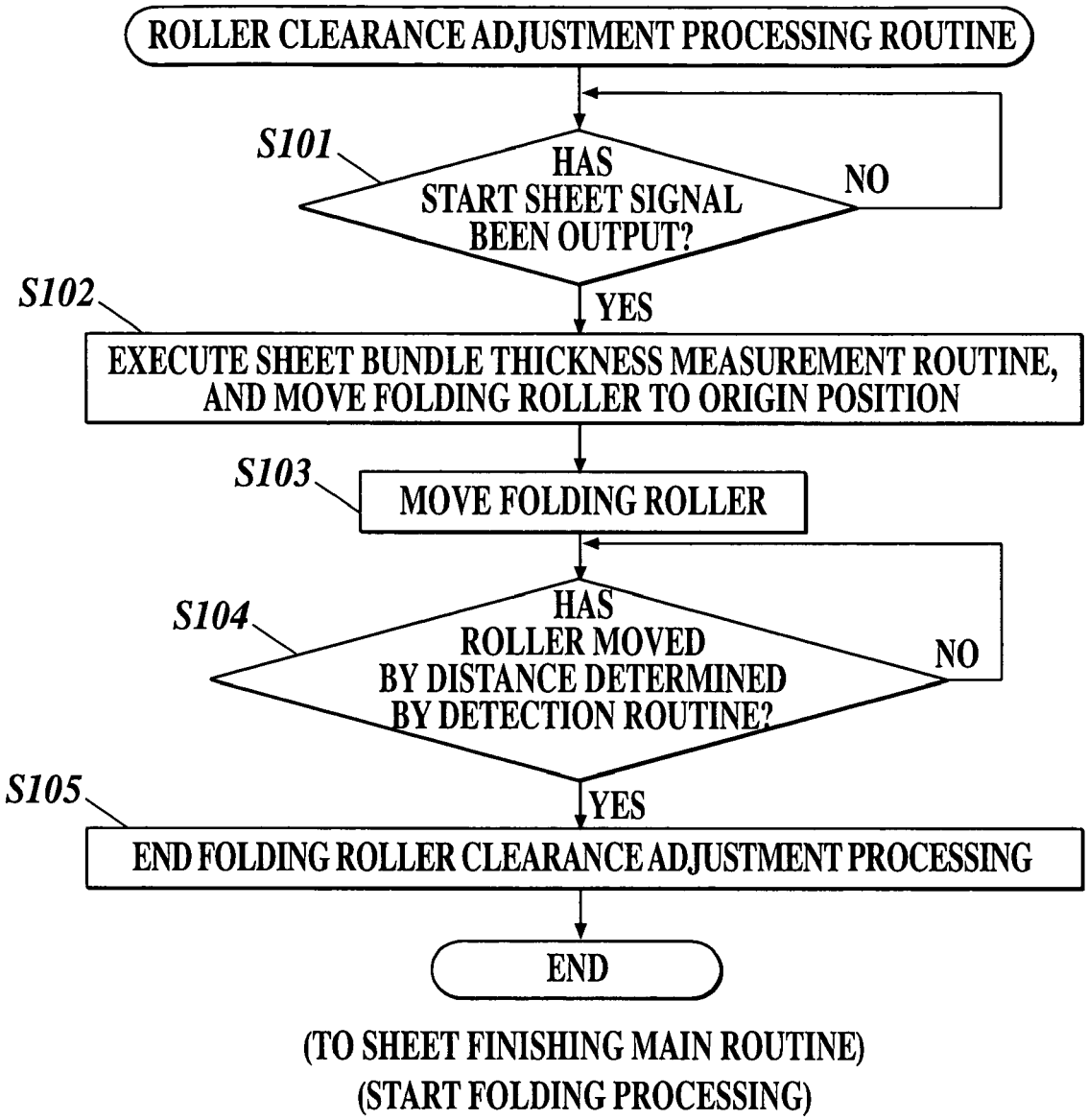
FIG. 6 is a flowchart showing a first embodiment according to folding processing of the sheet finisher.

FIG. 6 is a flowchart of a first embodiment according to the folding processing of the sheet finisher 1.

The control described in the following flow is performed by the control member C1.

(Roller Movement Clearance Adjustment Routine Adjusting Clearance Between Pair of Folding Rollers According to Thickness of Sheet Bundle)

The control member C1 waits a start sheet signal, which is a sheet conveyance start signal of a first sheet, from the image formation apparatus 2 (Step S101).

When the control member C1 receives the start sheet signal (Step S101: Yes), the control member C1 executes the sheet bundle thickness measurement routine, which will be described later, to measure the thickness of a sheet bundle, and moves the folding rollers 802 to the origin position (Step S102).

That is, the control member C1 reverses the rotation of the movement motor M2 of the drive unit 8073 to make the movement part 8071 descend until the origin sensor 809 stops detecting the movement part 8071, and makes the movement part 8071 (driven folding roller 802*b*) return to the origin position indicated by the solid line in FIG. 4.

Then, the control member C1 moves the folding rollers 802 (Step S103).

That is, in order to move the driven folding roller 802*b* to the position according to the thickness of a sheet bundle, the control member C1 normally rotates the movement motor M2 to move the movement part 8071 into the direction to be separated from the driving folding roller 802*a*.

Then, the control member C1 judges whether the movement of the folding rollers 802 for a distance determined by the detection routine has been completed or not (Step S104).

That is, the control member C1 counts the pulses of an encoder (not shown) connected to the movement motor M2, and compares a value acquired by the conversion of the counted value with the distance determined by the thickness measurement routine, which has been read from the RAM MR, to judge whether the movements of the rollers 802 have been completed (accorded) or not. Then, the control member C1 rotates the movement motor M2 until the converted value accords with the distance (Step S104: No).

In the case of using a pulse motor as the movement motor M2, drive pulses may be counted to be converted into a movement distance.

When the converted value accords with the distance (Step S104: Yes), the control member C1 stops the movement motor M2, and ends the folding roller clearance adjustment processing (Step S105).

Then, the control member C1 returns the processing to the sheet finishing main routine, and continues the control of the sheet finisher 1 described with reference to FIG. 1 including the folding processing.

Figure 7B:
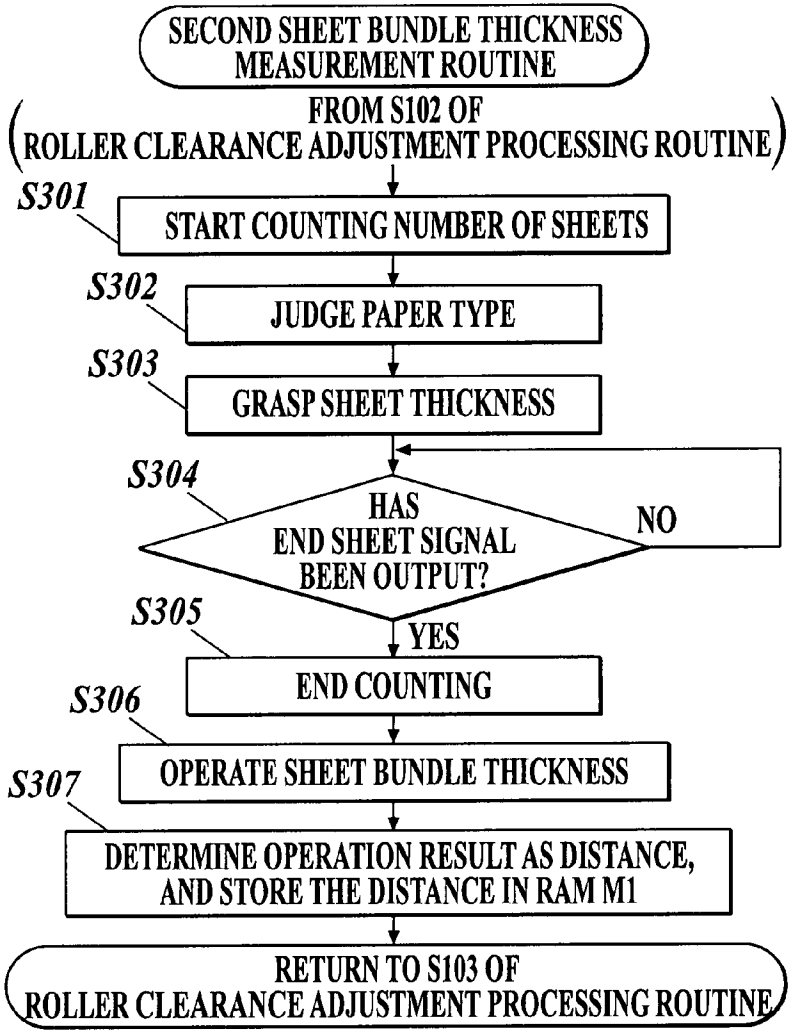
FIGS. 7A and 7B are flowcharts showing the measurements of the thicknesses of sheet bundles.
Figure 7A:
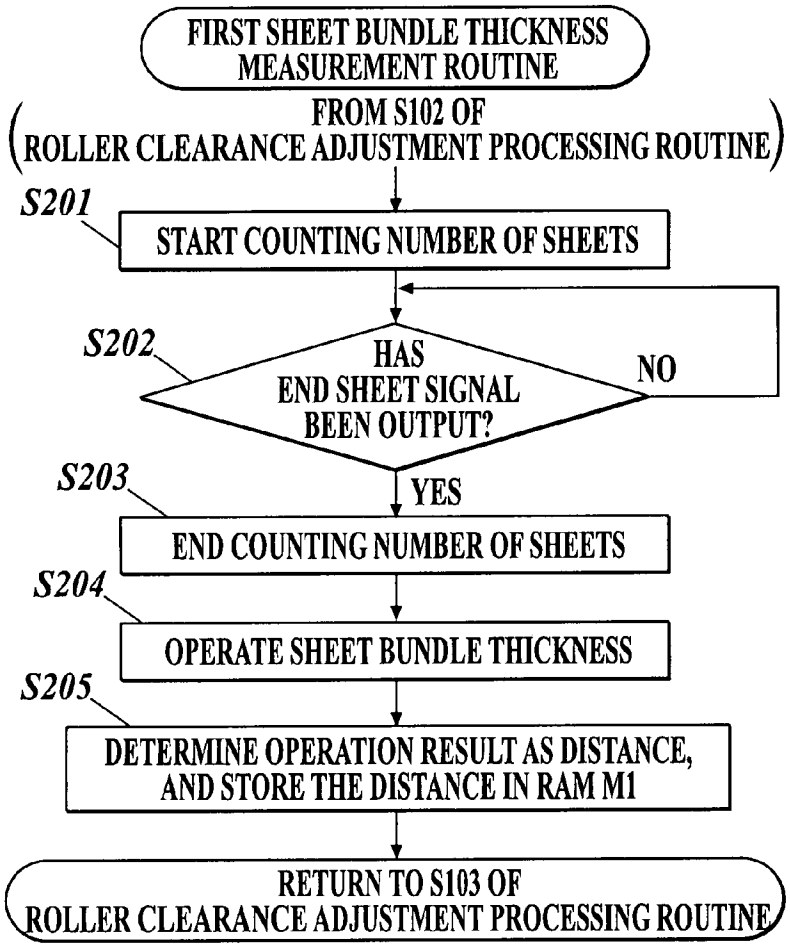

FIGS. 7A and 7B are flowcharts of measuring the thicknesses of sheet bundles.

FIG. 8 is an example of a correspondence table of paper types and thicknesses.

FIG. 7A is a flowchart of a first embodiment of the thickness measurement routine of measuring the thickness of a sheet bundle. The process jumps from Step S102 in FIG. 6 to the sheet bundle thickness detection routine to measure the thickness of the sheet bundle by a roller clearance adjustment processing routine execution direction, and the control member C1 measures the thickness of the sheet bundle.

The control member C1 starts the counting of the number of conveyed sheets (Step S201).

That is, because the control member C1 has received the start sheet signal, which is the sheet conveyance start signal of the first sheet of the sheet bundle, at Step S101 in FIG. 6, the control member C1 resets the contents of the counter in order to count the number of the sheets of the sheet bundle to be processed from now on, and thereafter the control member C1 starts the counting of the number of the sheets detected by the sheet sensor S1.

The control member C1 waits for the end sheet signal, which is the last sheet signal of the sheet bundle from the image formation apparatus 2, continuing the count of the sheets supplied to the sheet finisher 1 (Step S202).

When the control member C1 receives the end sheet signal (Step S202: Yes), the control member C1 ends the counting of the number of the sheets, and stores the counted value (e.g. n1) into the RAM MR as the number of sheets of the sheet bundle (Step S203).

The control member C1 reads sheet thickness (the average processible thickness of the sheets) data t1 stored in the ROM M in advance and the number of the sheets (n1) of the sheet bundle stored in the RAM MR, and operates the product of the sheet thickness t1 and the number of the sheets (n1) to operate the sheet bundle thickness (Step S204).

$$\text{sheet thickness } t1 \times \text{number of sheets}(n1) = \text{sheet bundle thickness } t11$$

The control member C1 stores the sheet bundle thickness t11 of the operation result into the RAM MR as a distance determined by the thickness detection routine (Step S205).

Then, the control member C1 returns the processing to Step S103 in FIG. 6.

FIG. 7B is a flowchart of a second embodiment of the thickness measurement routine measuring the thickness of a sheet bundle. The process jumps from Step S102 in FIG. 6 to the sheet bundle thickness detection routine to measure the thickness of the sheet bundle.

The control member C1 starts counting the number of the conveyed sheets (Step S301).

That is, because the control member C1 has received the start sheet signal, which is the first sheet conveyance start signal of the sheet bundle, the control member C1 resets the contents of the counter, and then starts the counting number of the sheets sensed by the sheet sensor S1.

The control member C1 judges the type of the sheet to be conveyed (Step S302). That is, with the paper type sensor S3 sensing the paper type of the sheet S to be conveyed in the third conveyance path (3), the paper type such as a glossy paper, a plain paper, a tracing paper and an OHP is detected.

Moreover, paper type information to be conveyed from the image formation apparatus may be acquired by performing communication with the image formation apparatus 2. In this case, the orders of Step S301 and Step S302 may be exchanged for each other.

The control member C1 grasps the thickness of the sheets conveyed (Step S303).

That is, the control member C1 reads the correspondence table of paper types and sheet thicknesses shown in FIG. 8, which has been previously stored in the ROM M, retrieves the sheet thickness (for example, t3 to plain paper) corresponding to the paper type (for example, the plain paper), and grasps the sheet thickness to be conveyed, for example, as t3 to store the sheet thickness (for example, t3) into the RAM MR.

The control member C1 waits for the end sheet signal, which is the last sheet signal of the sheet bundle from the image formation apparatus 2, continuing the counting of the number of the sheets supplied to the sheet finisher (Step S304).

When the control member C1 receives an end sheet signal (Step S304: Yes), the control member C1 ends the counting of the number of the sheets, and stores the counted value (for example n2) in the RAM MR as the number of the sheets of the sheet bundle (Step S305).

The control member C1 performs the operation of the sheet thickness (Step S306).

The control member C1 reads the sheet thickness (for example, t3) and the number of the sheets of the sheet bundle (for example, n2) which have been stored at Step S303, and-operates the product of the sheet thickness (t3) and the number of the sheets (n2) to operate a sheet bundle thickness (t22).

sheet thickness($t3$)×number of sheets($n2$)=sheet bundle thickness($t22$)

The control member C1 stores the sheet bundle thickness (t22) of an operation result into the RAM MR as a distance determined by the thickness detection routine (Step S307).

Then, the control member C1 returns the processing to Step S103 in FIG. 6.

Figure 9:
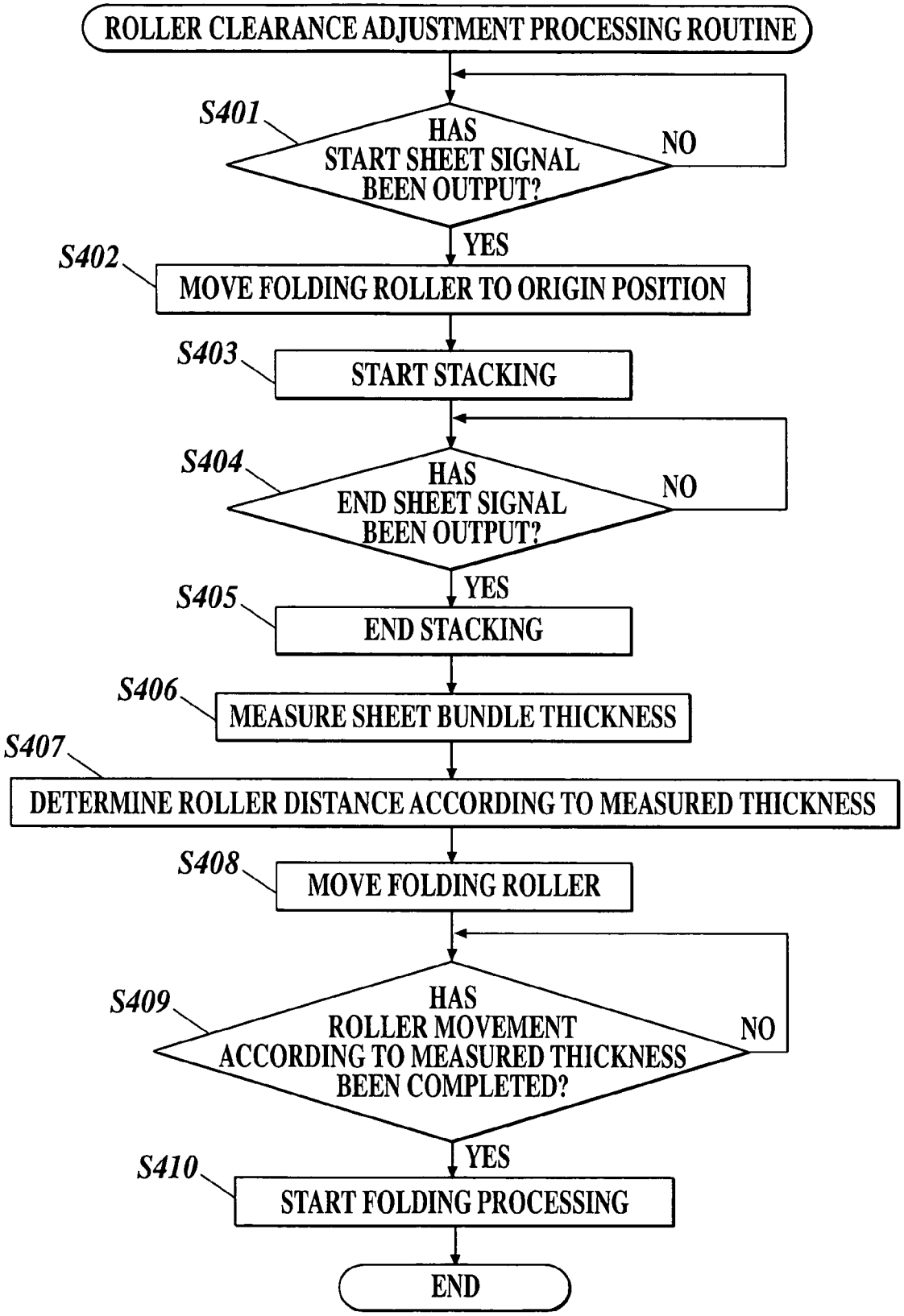
FIG. 9 is a flowchart of a second embodiment according to the folding processing of the sheet finisher.

FIG. 9 is a flowchart of a second embodiment related to the folding processing of the sheet finisher 1.

The control described in the following flow is performed by the control member C1.

(Roller Movement Clearance Adjustment Routine of Adjusting Clearance Between Pair of Folding Rollers 802 According to Thickness of Sheet Bundle)

The control member C1 waits for a start sheet signal which is a sheet conveyance start signal of a first sheet of a sheet bundle from the image formation apparatus 2 (Step S401).

When the control member C1 receives the start sheet signal (Step S401: Yes), the control member C1 moves the folding roller 802*b* to the origin position (Step S402).

The control member C1 starts stacking (Step S403).

That is, the control member C1 makes the sheets fed from the image formation apparatus 2 be stacked on the stacker 71.

The control member C1 waits for an end sheet signal (Step S404).

The control member C1 waits for the end sheet signal which is the last sheet signal of the sheet bundle from the image formation apparatus 2, continuing stacking.

The control member C1 ends stacking (Step S405).

When the control member C1 receives the end sheet signal (Step S404: Yes), the control member C1 ends the stacking.

The control member C1 measures a sheet bundle thickness (Step S406).

The control member C1 makes the sensor head 901 of the sheet bundle thickness sensor S4 contact with the sheet bundle accumulated on intermediate stacker 71, and measures the thickness of the sheet bundle.

The control member C1 determines the amount of distance of the rollers 802 according to the measured sheet bundle thickness (Step S407).

The control member C1 stores the measured sheet bundle thickness (for example, t33) into the RAM MR as a distance.

The control member C1 moves the folding roller 802*b* (Step S408).

The control member C1 judges whether the folding roller 802*b* has completed its movement according to the measured thickness or not (Step S409).

The control member C1 counts the pulses of the encoder (not shown) connected to the movement motor M2, and compares the value acquired by converting the counted value into a distance with the distance read from the RAM MR (measured sheet bundle thickness (t33)) to judge whether the roller 802*b* has completed its movement or not.

In the case of using a pulse motor as the movement motor M2, drive pulses may be counted to be converted into a distance.

The control member C1 starts folding processing (Step S410). The control member C1 rotates the movement motor M2 until the converted distance accords with the read distance (Step S409: No), and the control member C1 stops the movement motor M2 at a time when both the distances accord with each other (Step S409: Yes).

Then, the control member C1 returns the processing to the sheet finishing main routine, and continues the control of the sheet finisher including the start of the folding processing, which has been described with reference to FIG. 1.

Figure 10:
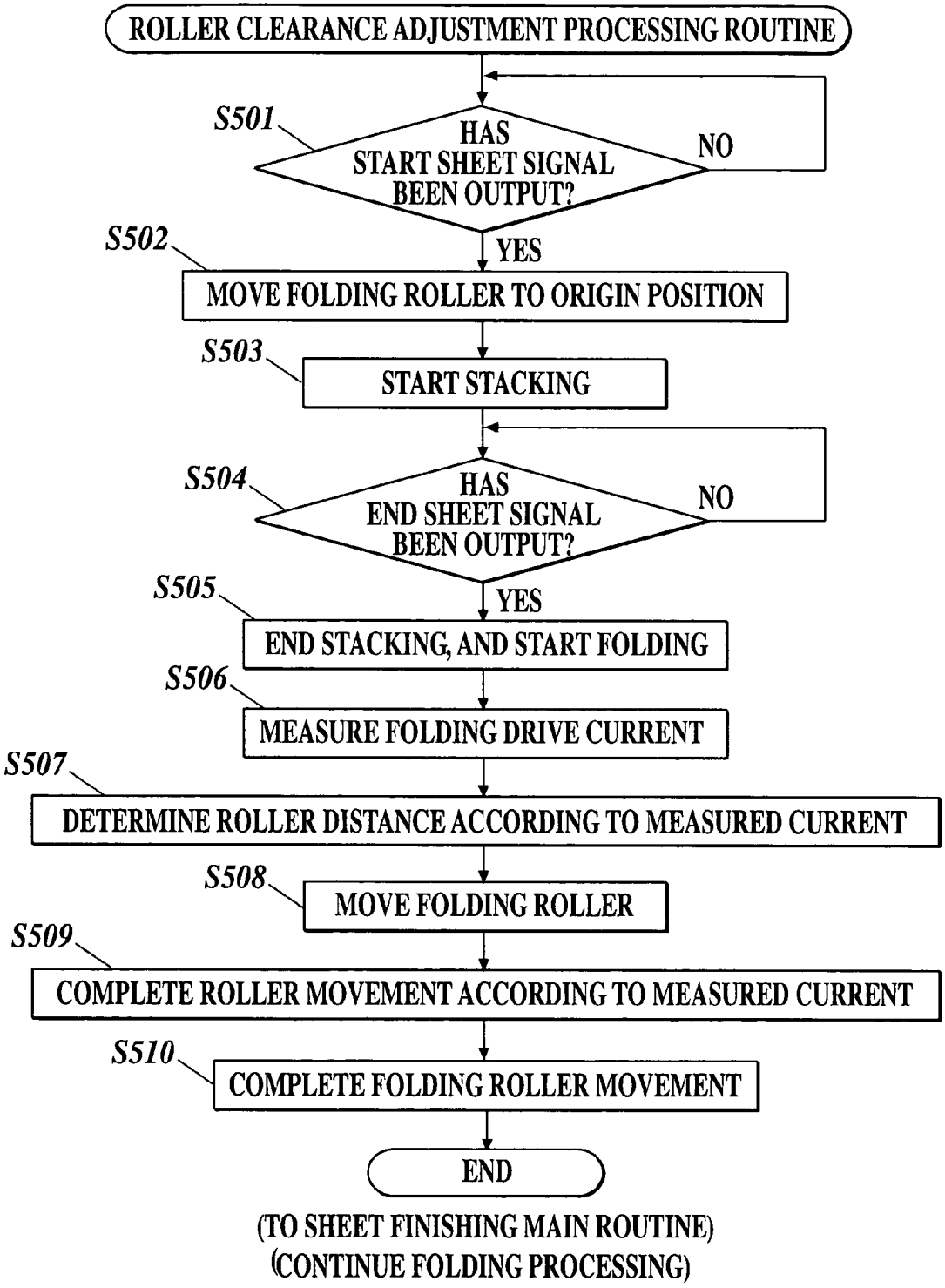
FIG. 10 is the flowchart of a third embodiment according to the folding processing of the sheet finisher.

FIG. 10 is a flowchart of a third embodiment according to folding processing of the sheet finisher.

FIG. 11 is an example of a correspondence table of consumption currents and sheet bundle thicknesses.

The control described in the following flow is performed by the control member C1.

The flow is to try to acquire the thickness of a sheet bundle from a drive consumption current of the drive unit of the pushing-in unit 801 at the time of pushing in the sheet bundle into the rollers 802 in the folding processing. The flow is based on a concept: when a sheet bundle is thick, large pushing-in force is required, and also a consumption current becomes large; and when a sheet bundle is thin, small pushing-in force is only required, and also a consumption current becomes small. That is, the control member C1 functions as the detection unit of the invention which detects the thickness of a sheet bundle from a table of sheet thicknesses to consumption currents based on the consumption current measured by the sensor S2.

(Roller Movement Clearance Adjustment Routine of Adjusting Clearance Between Pair of Folding Rollers According to Thickness of Sheet Bundle)

The control member C1 waits a start sheet signal which is a sheet conveyance start signal of a first sheet of a sheet bundle from the image formation apparatus 2 (Step S501).

When the control member C1 receives the start sheet signal (Step S501: Yes), the control member C1 moves the folding roller 802*b* to the origin position (Step S502).

The control member C1 starts stacking (Step S503).

That is, the control member C1 starts to stack the sheets fed from the image formation apparatus 2 onto the intermediate stacker 71.

The control member C1 waits for an end sheet signal (Step S504).

The control member C1 waits for the reception of the end sheet signal.

The control member C1 ends the stacking, and starts folding (Step S505).

When the control member C1 receives the end sheet signal (Step S504: Yes), the control member C1 completes the stacking, and starts the folding processing with the folding member 80 after the completion.

The control member C1 performs the measurement of folding drive current (consumption current) (Step S506).

The control member C1 measures the consumption current of the pushing-in motor M1 when the pushing-in unit 801 pushes the sheet bundle into the clearance between the driving folding roller 802*a* and the driven folding roller 802*b* with the current sensor S2 in the middle of the folding processing.

The control member C1 determines a roller distance according to the measured current (Step S507).

The control member C1 reads the correspondence table of consumption currents and sheet bundle thicknesses shown in FIG. 11, which have been previously stored in the ROM M.

The control member C1 retrieves the sheet bundle thickness corresponding to the consumption current (for example, i3) measured at Step S506 (for example, t13 to the consumption current i3. The control member C1 grasps the stacked sheet bundle thickness as a roller distance (for example, t13), and stores the roller distance (for example, t13) into the RAM MR.

The control member C1 performs folding roller movement (Step S508).

Similarly to the processing at Step S103, the control member C1 makes the movement motor M2 normally rotate to move the swing unit 804*b* into the direction to separate from the driving folding roller 802*a*.

The control member C1 performs the roller movement completion according to the measured current (Step S509).

The control member counts the pulses of the encoder (not shown) connected to the movement motor M2, and compares a value produced by converting the counted value into a distance with a roller distance (for example, t13) read from the RAM MR to rotate the movement motor M2 until both the distances accord with each other (Step S104: No).

The control member C1 completes the folding roller movement (Step S510).

When both the distances accord with each other (Step S104: Yes), the control member C1 stops the movement motor M2.

Then, the control member C1 returns the processing to the sheet finishing main routine, and continues the control of the sheet finisher including the continuation of the folding processing, which has been described with reference to FIG. 1.

Although the sheet finisher and the method thereof, which perform the folding processing after the staple processing, have been described above, the stapling processing may be performed after the folding processing by arranging the folding member on the upper stream of the stapling member. In this case, because the sheet bundle is not fixed with a staple, the effect of the prevention of misalignment of sheets becomes more remarkable by the present invention. Further, it is also possible that the acquiring member detects the thickness of the sheet bundle after the stapling member performs stapling and thereafter the control member controls the movement member so as to separate the pair of the rollers based on the thickness of the sheet bundle acquired by the acquiring member.

According to the present invention, the following effects can be acquired. By changing the clearance of the pushing rollers according to the thickness of a sheet bundle using the configuration described above, it becomes possible to provide a sheet finisher capable of stably producing a high-quality sheet bundle (booklet) folded at the center of the sheets without any misalignment of sheets independent of the thickness of the sheet bundle.

By changing the clearance between the pushing rollers according to the thickness of a sheet bundle before pushing the sheet bundle into the clearance between the pushing rollers, it becomes possible to provide a sheet finisher capable of stably producing a high-quality sheet bundle (booklet) folded at the center of the sheets without any misalignment of sheets independent of the thickness of the sheet bundle.

By changing the clearance between the pushing rollers according to the thickness of a sheet bundle, pushing the sheet bundle into the clearance between the pushing rollers, it becomes possible to provide a sheet finisher capable of stably producing a high-quality sheet bundle (booklet) folded at the center of the sheets without any misalignment of sheets independent of the thickness of the sheet bundle.

By driving one of the pushing rollers, it becomes possible to provide a simply-configured inexpensive sheet finisher capable of conveying a pushed-in sheet bundle to the next process without providing any dedicated conveying rollers.

By operating the thickness of a sheet bundle, and by changing the clearance between the pushing rollers based on the operation result, it becomes possible to provide a sheet finisher capable of stably producing a high-quality sheet bundle (booklet) folded at the center of the sheets without any misalignment of sheets independent of the thickness of the sheet bundle.

By actually measuring the thickness of a sheet bundle, and by changing the clearance between the pushing rollers based on the measurement result, it becomes possible to provide a sheet finisher capable of stably producing a high-quality sheet bundle (booklet) folded at the center of the sheets without any misalignment of sheets independent of the thickness of the sheet bundle.

By actually measuring a drive current (consumption current) at the time of pushing in a sheet bundle, and by changing the clearance between the pushing rollers based on the measurement result, it becomes possible to provide a sheet finisher capable of stably producing a high-quality sheet bundle (booklet) folded at the center of the sheets without any misalignment of sheets independent of the thickness of the sheet bundle.

By including the step of measuring the thickness of a sheet bundle, and the step of pushing the sheet bundle into the clearance between the pushing rollers widened based on the measured thickness, it becomes possible to provide a sheet finisher capable of stably producing a high-quality sheet bundle (booklet) folded at the center of the sheets without any misalignment of sheets independent of the thickness of the sheet bundle.

By including the step of operating the thickness of a sheet bundle, it becomes possible to provide a sheet finisher capable of stably producing a high-quality sheet bundle (booklet) folded at the center of the sheets without any misalignment of sheets independent of the thickness of the sheet bundle.

By including the step of actually measuring the thickness of a sheet bundle, it becomes possible to provide a sheet finisher capable of stably producing a high-quality sheet bundle (booklet) folded at the center of the sheets without any misalignment of sheets independent of the thickness of the sheet bundle.

By measuring the thickness of a sheet bundle during pushing in the sheet bundle, and by changing the clearance between the pushing rollers based on the measured result, it becomes possible to provide a sheet finisher capable of stably producing a high-quality sheet bundle (booklet) folded at the center of the sheets without any misalignment of sheets independent of the thickness of the sheet bundle.

The above-described present embodiments exemplifies the measuring method of the sheet bundle of calculating it from the number of papers, calculating it from the number of papers and a paper type, and calculating it from a consumption current of the push-in member. The thickness of the sheet bundle also may be measured by the sheet bundle thickness sensor S4.

In the present embodiments, the sheet finisher and image forming apparatus are each constituted as separate apparatuses. The image forming apparatus may be constituted to include the sheet finisher integrally.

What is claimed is:

1. A sheet finisher comprising:

a push-in member to push a sheet bundle;

a pair of rollers to fold the sheet bundle pushed-in by the push-in member;

a movement member to move at least one roller of the pair of rollers;

an acquiring member to acquire information of a thickness of the sheet bundle; and a control member to control the movement member so as to adjust a clearance between the pair of rollers, based on the information of the thickness of the sheet bundle acquired by the acquiring member;

a drive member to drive the push-in member; and a measurement member to measure a consumption current of the drive member;

wherein the acquiring member comprises: a detection unit to detect the thickness of the sheet bundle from a correspondence table of consumption currents and sheet bundle thicknesses, based on the consumption current measured by the measurement member; and wherein the control member controls the movement member so as to adjust the clearance between the pair of rollers, based on the thickness of the sheet bundle acquired by the acquiring member.

2. The sheet finisher of claim 1, wherein the control member controls the movement member so as to adjust the clearance between the pair of rollers based on the information of the thickness of the sheet bundle, while the push-in member pushes the sheet bundle into the clearance between the pair of rollers.

3. The sheet finisher of claim 1, wherein at least one roller of the pair of rollers is driven to rotate, and the control member controls the movement member so as to move the other roller based on the information of the thickness of the sheet bundle.

4. The sheet finisher of claim 1, further comprising:

a stapling member to staple the sheet bundle, wherein the detection unit of the acquiring member detects the thickness of the sheet bundle after the stapling member staples the sheet bundle.

5. A sheet finishing method comprising:

operating a push-in member to push-in a sheet bundle between a pair of rollers;

operating the pair of rollers to fold the pushed-in sheet bundle;

operating a movement member to move at least one roller of the pair of rollers;

acquiring information of a thickness of the sheet bundle by an acquiring member;

controlling the movement member by a control member so as to adjust a clearance between the pair of rollers, based on the information of the thickness of the sheet bundle acquired by the acquiring member;

driving the push-in member by a drive member; and measuring a consumption current of the drive member by a measurement member;

wherein the acquiring member comprises: a detection unit to detect the thickness of the sheet bundle from a correspondence table of consumption currents and sheet bundle thicknesses, based on the consumption current measured by the measurement member; and wherein the control member controls the movement member so as to adjust the clearance between the pair of rollers, based on the thickness of the sheet bundle acquired by the acquiring member.

6. The sheet finishing method of claim 5, further comprising:

stacking a sheet, and wherein the information of the thickness of the sheet bundle is acquired by the acquiring member after the stacking is finished.

7. The sheet finishing method of claim 5, wherein the information of the thickness of the sheet bundle is acquired by the acquiring member while the push-in member pushes the sheet bundle into the pair of rollers, and the movement member is controlled by the control member during the pushing-in of the sheet bundle.

8. An image forming apparatus comprising:

an image forming member to form an image on a sheet;

a conveyance member to convey the sheet from the image forming member;

a push-in member to push a sheet bundle of the sheet conveyed from the conveyance member;

a pair of rollers to fold the sheet bundle pushed-in by the push-in member;

a movement member to move at least one roller of the pair of rollers;

an acquiring member to acquire information of a thickness of the sheet bundle; and a control member to control the movement member so as to adjust a clearance between the pair of rollers, based on the information of the thickness of the sheet bundle acquired by the acquiring member;

a drive member to drive the push-in member; and a measurement member to measure a consumption current of the drive member;

wherein the acquiring member comprises: a detection unit to detect the thickness of the sheet bundle from a correspondence table of consumption currents and sheet bundle thicknesses, based on the consumption current measured by the measurement member; and wherein the control member controls the movement member so as to adjust the clearance between the pair of rollers, based on the thickness of the sheet bundle acquired by the acquiring member.

9. The image forming apparatus of claim 8, wherein the control member controls the movement member so as to adjust the clearance between the pair of rollers based on the information of the thickness of the sheet bundle, while the push-in member pushes the sheet bundle into the clearance between the pair of rollers.

10. The image forming apparatus of claim 8, wherein at least one roller of the pair of rollers is driven to rotate, and the control member controls the movement member so as to move the other roller based on the information of the thickness of the sheet bundle.

* * * * *